United States Patent [19]

Davidson et al.

[11] Patent Number: 5,067,968

[45] Date of Patent: Nov. 26, 1991

[54] BRIQUETTE PRODUCT, AND PROCESS FOR ITS PRODUCTION

[76] Inventors: Joseph W. Davidson, 2645 Dutch Ridge Rd., Guysville, Ohio 45735; Geoffrey Blackmore, 3418 Laredo Dr., Lexington, Ky. 40502; Gerald Blackmore, 3784 Jamaica Ct., Lexington, Ky. 40509; Karl R. Komerek, deceased, late of Elk Grove, Ill.; by Richard Komerek, executor, 1825 Estes Ave., Elk Grove, both of Ill. 60007

[21] Appl. No.: 607,214

[22] Filed: Nov. 1, 1990

Related U.S. Application Data

[63] Continuation of Ser. No. 316,779, Feb. 28, 1989, abandoned.

[51] Int. Cl.[5] ..... C10L 5/00; C10L 5/08; B30B 11/00

[52] U.S. Cl. ..... 44/550; 44/597; 44/636; 100/92

[58] Field of Search ..... 44/11-14, 44/593-596, 604, 597; 100/92

[56] References Cited

U.S. PATENT DOCUMENTS

| | | | |
|---|---|---|---|
| 1,609,498 | 12/1926 | Stillman | 44/593 |
| 2,675,304 | 4/1954 | Komarek | 44/595 |
| 2,937,080 | 5/1960 | Komarek et al. | 44/593 |
| 4,148,613 | 4/1979 | Myers | 44/604 |
| 4,235,603 | 11/1980 | Miller et al. | 44/10 R |

FOREIGN PATENT DOCUMENTS

| | | | |
|---|---|---|---|
| 704745 | 3/1954 | United Kingdom | 44/594 |
| 807433 | 11/1959 | United Kingdom | 44/596 |

OTHER PUBLICATIONS

U.S. Department of Energy Publication ET 14303, "Briquetting of Fine Coal Using a Sodium Chloride Binder" Oct. 1981.

Jones, G. S. and D. B. Mecham, "The Pelletization of Fine Coal-Parts I and II" British Coal Board Publication.

Conkle, H. N. and W. J. Dawson, "Final Report on Reconstitution of Physically Cleaned Coal to Standard Oil Co. of Ohio" Batelle Laboratories, 3/29/84.

Miller, M. R. et al., "Coal Briquetting Without A Binder" Iowa State University, Technical Paper IS-IC-P-67.

*Primary Examiner*—Carl F. Dees

*Attorney, Agent, or Firm*—Rothwell, Figg, Ernst & Kurz

[57] ABSTRACT

The briquetting of bituminous coals without the use of extraneous binders is effected by a system of high temperature, high pressure mold forming of the coal fines material in an apparatus incorporating a high pressure roll-type briquetting press, to provide briquettes of enhanced quality and handeability, with good crushing strength and high impact resistance. The system incorporates a positive pressure controlled oxygen, gas recirculation flash-dryer, and a direct briquette product to raw feed heat exchange system and other innovative heat management arrangements, for high system efficiency.

29 Claims, 3 Drawing Sheets

BRIQUETTE PRODUCT, AND PROCESS FOR ITS PRODUCTION

This is a continuation-in-part of application Ser. No. 07/316,779, filed Feb. 28, 1989 now abandoned.

FIELD OF THE INVENTION

This invention is directed to the briquetting of coal fines, and in particular to a process and apparatus for effecting the briquetting, and to the product thus produced.

BACKGROUND OF THE INVENTION

In the mining, processing and handling of coal enormous tonnages of fines are created. Typically, about fifteen to twenty percent of the tonnage mined, after handling and cleaning is completed, comprises fines having a size range from powder up to small granular.

Much of this coal fines is not directly usable, and historically the problem has only recently been reapproached, due to the resurgence of coal as a consequence of the politicised escalation of oil prices, as a result of increasingly more stringent customer demands in respect of the quality of coal supplied them by the producers, and because of the increasing regulation of mine waste disposal practices to satisfy environment standards.

The prior art vis a vis coal briquetting focused on the low pressure briquetting of coal fines, using a binder, typically of coal tar origin, to hold the individual particles together. While this technology flourished during the early part of the present century, when the binder-briquetted product was substantially utilized as a home heating fuel, this application has essentially disappeared since the end of World War II as a result of a shift to other and more convenient sources of fuel.

While a certain portion of the fines can often be sold to the customer in combination with the coarser fractions of the mine production, the inclusion of the whole of the recoverable quantities of fines may result in downgrading the quality of the combined product below market requirements.

The fines material is frequently in the form of a wet filter cake, containing between about twenty and thirty percent moisture, depending upon its size distribution and ash content. In a dry state however, the fines are generally predominantly passable through a twenty eight mesh screen. Up to 1/16 inch mesh screen may be used.

Another potentially available form of high quality fines is the discard material produced by current and/or previous coal preparation facilities in which the fines were not efficiently recovered by the previous process, or else were present in such quantities as to make their total recovery and incorporation into the mine product impractical in respect of market requirements.

In the recent past the reconstitution of fines by extrusion, pelletizing and briquetting generally has involved the use of a binder or binders, including starch, sodium chloride, portland cement, and coal tar, now recognized as a carcinogen.

In use it has been found that medium to small sized briquettes of regular form provide excellent combustion characteristics on chain grates and similar types of stoker arrangements. However, the presence of the binders can contribute to highly undesirable air pollution, and/or give rise to undesirable combustion characteristics in the reconstituted fuel.

Also, the use of binders adds significantly to the cost of the reconstituted product.

Attempts to carry out binderless briquetting at low temperatures have encountered problems, both in the handling of the fines feed stock, and also in the strength and other physical characteristics such as water absorbtion of the product thus produced.

Many aspects of the prior art handling of coal fines are dealt with in the following listed publications:

U.S. Department of Energy Pubn. ET 14303 Oct. 1981: "Briquetting Of Fine Coal Using A Sodium Chloride Binder".

British Coal Board: Paper by G. S. Jones & D. B. Meecham: "The Pelletization of Fine Coal"—Parts I and II.

Battelle Laboratories, Columbus, Ohio, U.S.A. Report by W. H. Conkle and J. W. Dawson: "Reconstitution of Physically Cleaned Coal."

Other attempts to briquette coal fines have involved medium pressure, long duration binderless processes wherein the coal fines require a preparatory treatment of washing in an organic solvent medium, in order to liberate material from the coal, to serve as a binder in the subsequent pressure forming process. The press pressures used range from 4,000 to 30,000 p.s.i., and the process appears to yield an improved product. However, solvent recovery presents capital cost and other problems, to render the process impractical. This work is to be found in the Iowa State University technical paper IS-ICP-67 for the Energy and Mineral Resources Research Institute: "Coal Briquetting Without a Binder," Miller et al Oct. 1, 1979; and in U.S. Pat. No. 4,235,603 Nov. 25, 1980, Miller et al.

In considering the significance of the physical characteristics of reconstituted coal fines in briquette form it should be born in mind that commercial use generally invovles bulk handling with storage in a stockpile open to the elements, and bulk transfer, using heavy machinery. Thus, in addition to the abuses of mechanical handling, and the usual self weight loading which occurs in a high stockpile, the effect of the elements leads to repetitious wetting and drying of the briquettes.

In the case of porous or semi-porous briquettes which can readily take on water, in addition to sustaining physical damage and suffering an effective calorific heat loss due to any absorbed water load, the batch heating value of the porous briquettes of the prior art is unpredictable, while the stockpile itself may become a source of environmental polution.

SUMMARY OF THE INVENTION

The present invention provides a system for briquetting particulate coal fines, comprising the steps of: substantially drying the particulates and raising the temperature thereof to about the boiling point of water in a reducing environment; compressing the material to an extent to effect bonding between at least some of the particles thereof to form a cohesive mass of predetermined form and strength characteristics; releasing the pressure; and cooling the mass to below the autoignition temperature thereof.

Press forming pressures of between about 30,000 to 50,000 pounds per square inch have been found to yield acceptable product.

The system further comprises the steps of passing the feed material rapidly through a flash type dryer/heater, system which utilizes high velocity, high temperature reducing gases.

The system further includes passing the hot exhaust gases from the dryer through an air-air heat exchange mechanism for pre-heating of the ambient temperature combustion air which is supplied to the heat generating source.

The system further includes the step of crushing and recycling limited amounts of material prepared by the process to enhance the agglomaration characteristics of the material in the compression step.

The invention further provides the step of exchanging heat between hot, formed material and incoming particulate feed material at a lower temperature, by direct heat exchange therebetween.

The system includes steps for the start up and operation of the dryer/heater system under a fuel-rich condition, to provide a reducing atmosphere and raising the ambient pressure within the dryer/heater to above atmospheric pressure to preclude the ingress of air thereto.

An apparatus is provided for carrying out the process, having a flash dryer, with burner means operable in a fuel rich condition to provide a reducing atmosphere therein, and blower means to raise the pressure of the reducing atmosphere above barometric, to preclude the ingress of air thereto.

In a preferred embodiment the flash dryer has a hot gas mixing chamber surmounted by an upwardly extending heat tube; blower means located in gas circulating and compressing relation therewith; and gas recirculation means for recirculating a predetermined portion of exhaust gas to the hot mixing chamber; separation means for separating solids from hot exhaust gas; press means for pressing the separated solids into a predetermined form; and cooling means for cooling the pressed solids to a predetermined temperature, which is below the auto-ignition temperature of the pressed solids.

The press means employed may include a pre-compression auger, in addition to a press such as a twin roll, high pressure press.

Operation of the present process under the conditions referred to below will generally provide a consolidated coal briquette having a hardened case of relatively low porosity. Pressing in a desired temperature and pressure range promotes plastic flow, to improve the briquette thus formed, in strength and handling characteristics. In a preferred case, the temperature of the feed stock is raised to a degree sufficient to cause a substantially complete extent of plastic flow in the briquette during high pressure forming thereof to achieve optimum strength and handleability, after being cooled. The actual values of strength have been observed to further increase after a period of curing, in a cool state, presumably as a result of chemical phenomena induced in the product as a consequence of the process.

The actual strength and handleability achieved may be determined by drop tests and crushing load tests. Typical such tests may be a free drop test of individual briquettes from a height of fifteen to twenty feet, onto a plain concrete surface; and a crushing dead load test, using a rigid loading plate of a predetermined size. Crushing strengths as high as 120 to 130 pounds per square inch are generally desirable.

The preferred feed stock consists of clean bituminous coal fines, the suitability of which for use with the presently disclosed process is established by extensive tests.

The briquettes formed in accordance with the present invention preferably contains a total moisture content substantially equal to or less than the inherent moisture content of the parent feed material. It will be understood that inherent moisture content of parent feed material denotes the drying off of all superficial moisture, as determined by standard laboratory practice.

It is contemplated that in addition to established use with bituminous coal fines the presently disclosed process and plant, or modifications thereof, are suitable for use in briquetting of low rank sub-bituminous coals, to provide briquettes of enhanced characteristics, vis a vis those of the parent material; i.e. reduced moisture content, higher calorific value, reduced propensity for auto-ignition, and improved handleability.

Experience has shown that in the circumstances of commencing with substantially dry stock bituminous coal having essentially less than one percent surface moisture, it may be possible to briquette at a temperature of the stock of about 75° C. (170° F.). It will be understood that the quality of such low temperature briquettes lacks in handling strength and waterproofness. However, the problem of blow-away may be solved by such use.

Because of the relative absence of bitumen material in anthracite and like hard coals, feed materials of these higher rank coals may not respond as favorably as do the lower bituminous coals to the process herein described.

The presently disclosed process has been used successfully and safely, in the manner disclosed, with clean, washed bituminous coal fines to produce briquettes of enhanced characteristics. In the case of fully plasticised briquettes, wherein the combination of temperature and pressure are such as to produce plastic flow in the whole of the briquette cross-section during the forming process, the tendency to absorb water is significantly reduced, to the point of being substantially eliminated.

The achievement of case—hardening, wherein a consistent, substantially homogeneous, generally crack-free hardened case is provided to the briquette can greatly reduce the tendency to absorb water, and so enhances the value of the briquette.

It will be appreciated that certain benefits may be obtained by making use of portions only of the total process, wherein the total process as disclosed is not fully utilized. Thus, use of a controlled oxygen, gas recirculation, fully pressurized flash dryer in the drying and/or heating or certain types of coal may be novel, per se, as is also the use of direct heat exchange between the hot and freshly formed coal product and the ambient temperature wet feed stock, for the combined purpose of cooling the product and pre-heating the feed stock by means of direct heat transfer therebetween. Tests carried out in a pilot plant produced briquettes of generally ovoid section, both lateral and longitudinal, sized about one by threequarters by one half inches.

It is stressed, and coal industry experience supports, that operation dryer/heater below atmospheric pressure invites the ingress of air, and thus the danger of an explosion in the dryer/heater.

The present invention makes readily possible the inclusion of crushed limestone or other calcitic/dolomitic divalent base earth materials, for purposes of capturing as sulphates a portion of the sulphur dioxide emissions that are produced when the fuel is burned, and so reduce sulphur dioxide emissions. The addition of up to about five percent by weight of such divalent base earth materials, on a calcium equivalent basis is contemplated.

DESCRIPTION OF THE DRAWINGS

Certain embodiments of the present invention are described by way of illustration, and without limitation of the invention thereto, reference being made to the accompanying drawings, wherein.

DETAILED DESCRIPTION OF THE INVENTION

Figure 1:
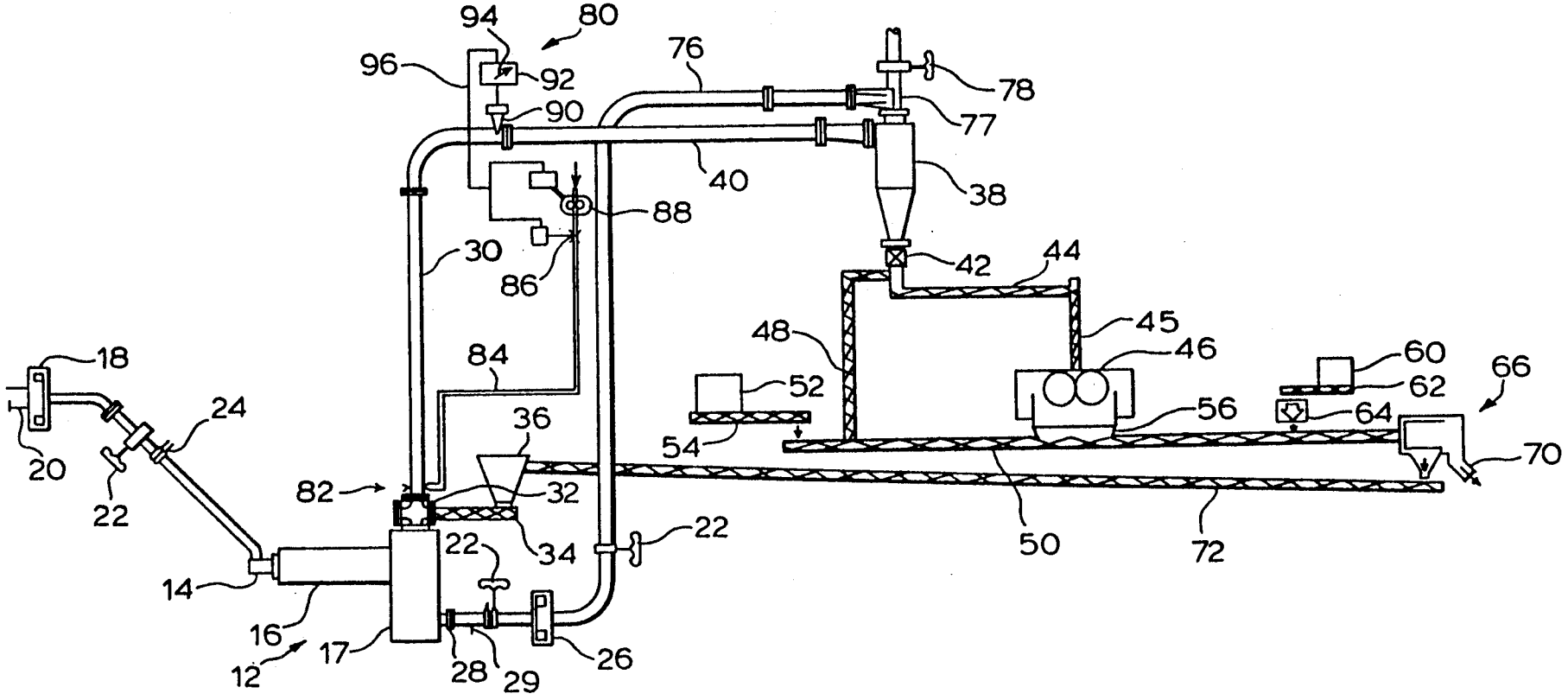
FIG. 1 is a schematic side view of a briquetting apparatus in accordance with the present invention.

Referring to FIG. 1, the briquetting apparatus 10 comprises a hot gas generator 12 having a burner 14 and a combustion chamber 16. The burner 14 has a combustion air blower 18, with controllable inlet damper means 20, a discharge flow regulating damper 22, and discharge flow measuring means 24 by which the volume and pressure of air delivered to burner 14 can be monitored and controlled.

A recycle blower 26 is connected at port 28 to hot gas chamber 17, having flow volume and pressure measuring means 29 by which to monitor the recycle gas flow, and pressure controllable damper means 22 and discharge flow regulating means 22 in the respective inlet and outlet of blower 26 also are provided to facilitate control of the volume and pressure of recycle gas delivered by recycle blower 26 into port 28.

A flash-dryer evaporator tube 30 extends upwardly from the mixing chamber 17, having a tee piece 32 at the lower end thereof connected to a stock feed auger 34 and feed surge hopper 36.

The upper end of tube 30 connects with a cyclone separator 38, by way of a tube 40.

The separator 38 has a rotary air lock 42 at the bottom outlet thereof, for the passage of dried feed stock and a small quantity of transport gas sufficient to maintain inert the heated dry coal to conveyor 44, which connects by way of a feed pre-densification auger 45 with a twin roll briquetting press 46, preferably of the high pressure type as manufactured by K. R. Komarek, Inc. of Elk Grove, Ill., U.S.A.

A feed overflow by-pass auger 48 connects the conduit 44 with a combined feed transport/pre-heating and hot briquette cooling auger-type feed conveyor 50.

The briquette press delivery outlet 56 connects with the feed conveyor 50, which receives the hot briquettes.

A briquette recycle hopper 60 receives a portion of the briquettes for crushing and return by way of an auger 62 and briquette crusher 64, to the feed conveyor 50.

A screen-type separator 66 at the discharge end of feed conveyor 50 receives pre-heated green feed from stock feed hopper 52; together with bypass feed from bypass 48, hot briquettes and excess feed stock from the briquetting press 46, and crushed briquettes from the crusher 64.

This separator 66, of the trommel screen type or other appropriate type, separates the partially cooled briquettes to delivery chute 70 and the remaining preheated, fine sized contents of conveyor 50 to a transfer conveyor 72, which feeds surge hopper 36.

A portion of the thus delivered briquettes are returned to briquette recycle hopper 60, and thence to the crusher 64, for crushign and recycling.

The vortex discharge from cyclone separator 38 is upward and is connected by means of a tee piece of 77 to the off-gas stack 74 and the gas recirculation tube 76. Gas recirculation tube 76 connects with recycle blower 26.

Distribution of the cyclone exhaust gas between the off-gas stack 74 and gas recirculation tube 76 is effected by damper means 78 which is installed in off-gas stack 74 downstream of tee-piece 77.

A temperature control sub-system 80 comprises a cooling water injector 82 located in evaporator tube 30. Water supply pipe 84 connects with variable flow control valve 86 which is connected with a water supply. A water supply pump 88 is illustrated, being fed from a supply (not shown).

A temperature sensor 90 in the tube 40 is connected in controlling relation with controller 92, which has a setpoint control 94. The control output 96 connects with the water flow control valve 86 and the water supply pump 88, in flow controlling relation therewith.

In operation of the system, wet stock, is fed to hopper 52. Stock feed auger 54 deposits the wet stock into the conveyor 50, which in the pilot plant also comprises an auger conveyor.

The conveyor 50 also receives from bypass auger 48 an overflow of dried stock feed that is excess to the feed requirements of the press 46.

The feed of dried stock to press 46, by way of transfer auger 44 and pre-densification auger 45 results in the formation of briquettes in press 46 and passage of the hot briquettes together with any stock which overflows press 46, by way of press delivery outlet 56, onto conveyor 50.

The conveyor 50, being of auger type, serves to mix the respective deposits of hot briquettes, by-passed hot dried stock feed, and cool feed materials, so that beneficial heat exchange takes place.

The contents of conveyor 50 are further complemented by recirculated crushed briquettes, by way of recycle hopper 60 and briquette crusher 64, which crushed material serves to assist in subsequent particle agglomeration in the process.

The mixture, of wet feed, dry particulates, hot briquettes and crushed briquettes is intermixed and delivered by conveyor 50 to the screen of separator 66. During this mixing and conveying process, the briquettes are cooled to below auto-ignition temperature by means of direct heat transfer with the balance of the conveyor contents, the latter thus being pre-heated prior to introduction into the dryer/heater means as noted below.

Following separation of the cooled briquettes, the briquettes are delivered by chute 70 for storage. The pre-heated "through" material from screen 66 which constitutes the balance of the material delivered by auger 50 is returned by transfer conveyor 72 to the surge feed hopper 36.

Stock feed auger 34 feeds the partially dried and heated stock from surge hopper 36 to the feed tee piece 32, near the bottom of the evaporator tube 30.

High velocity hot gases from mixing chamber 17 entrain the feed particles and move them rapidly up the tube 30, and by way of tube 40 to the separator cyclone 38, where the gases and the then heated and dried particles are separated.

Initial entrainment of the feed material introduced at tee piece 32 into the hot gas stream in evaporator tube 30 may be assisted by means of a venturi nozzle arrangement (not shown) located immediately below tee piece 32.

Following separation from the hot gas transport stream by means of cyclone 38, the dried, hot particles pass downwardly through air lock 42, below which a recycle portion of the solids stream is captured by bypass auger 48, and transferred to conveyor 50, as referred to, above. The auger 44 conveys a sufficient amount of the hot dried feed to assure that pre-densification auger 45 runs full, and the capacity of press 46 also is filled.

Turning to the gas handling aspects of the process, air enters the system by way of blower 18 and passes to burner 14 and combustion chamber 16, together with the fuel. The inlet damper means 20, flow damper 22 and fuel supply are regulated to achieve a fuel rich, oxygen deficient condition (i.e. less than the stoichiometric oxygen requirement) in the combustion chamber 16, and also in mixing chamber 17.

The hot combustion gases thus obtained contain trace quantities of carbon monoxide and is a so-called reducing gas having no excess air present to provide free oxygen or to support combustion.

Recirculated stack gas from the cyclone separator 38, which is recycled by way of pipe 76 and blower 26 also passes into mixing chamber 17. The recycle gas is of the same chemical composition as the combustion gases evolved from combustion chamber 16 with respect to its free oxygen content, and therefor may also be considered as reducing (i.e. non oxydizing) gas. However, the recycle gas will contain a significantly higher concentration of water vapor, as steam, as a result of moisture evaporated in the flash dryer 30.

The quantity of stack gas leaving the process per unit of time need be sufficient only to remove the moisture evolved in the drying of the wet feed stock, and the products of combustion produced by burner 14.

The wet feed stock enters the process, usually in the range of about 20 to 30% moisture, by weight, and is dried to a level which is about equal to or less than the inherent moisture content of the particular run of coal being processed, which for many bituminous coals is usually in the range of 2% moisture by weight, or less.

The presence of reducing gas throughout the gas circulation path, raised to a pressure above atmospheric by way of blowers 18 and 26, totally precludes the ingress of air, so that normally no combustion of the hot materials can take place even though the temperature of these materials may be above the auto-ignition temperature thereof.

The exchange of heat between the hot formed product and the cooler feed, and recirculation of hot reducing gas from the separator, all contribute to the efficiency of the process. This efficiency may be further boosted by passing the exhausted stack gas in warming relation with the incoming and ambient temperature combination air which is supplied to the intake side of blower 18 before passing the exhaust gas by way of a filtration system (not shown) such as a bag house, and thence to atmosphere.

The start up and operation of the system is materially facilitated by the water injection system 80, by means of which the temperature of the gas stream in evaporator tube 30 is controlled. Thus, the system can be started up under zero feed condition by circulating gas and operating the hot gas generator 12, until temperatures are stabilized under evaporative load condition which approximate processing conditions that normally prevail. The introduction of feed can then commence, and be progressively increased while correspondingly reducing the quantity of water supplied to tube 30 by injection system 80, until full dry solids production is reached, all the while maintaining heat demand of the system substantially constant.

Figure 2:
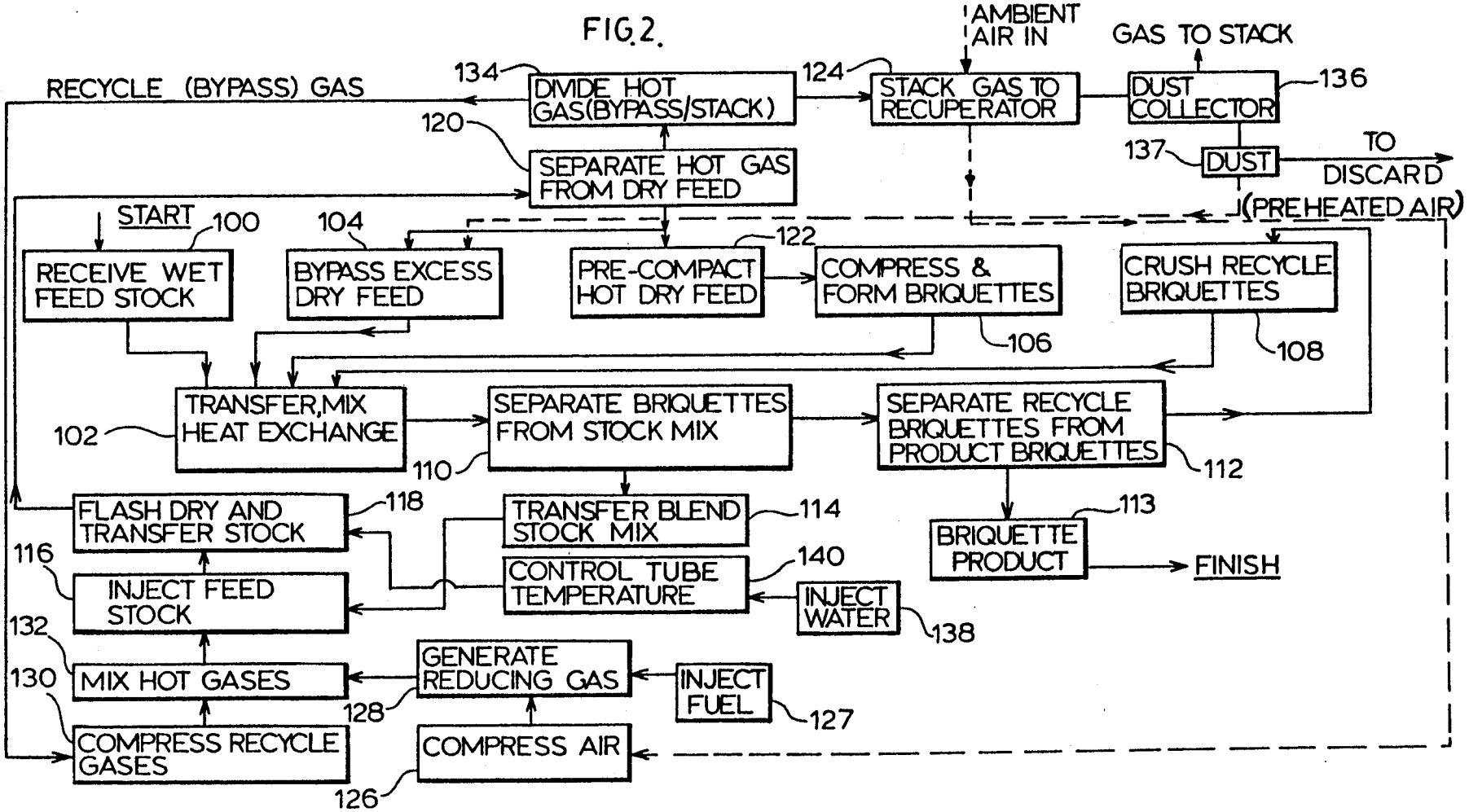
FIG. 2 is a flow chart of the process of this invention.

Referring to FIG. 2, the process according to the present invention has a number of aspects, such as coal handling, air handling, water coolant control, and heat exchange functions, which combine to form the process of the present invention.

The incoming wet feed stock enter the process at Block 100 (see "START") and is transferred to the auger conveyor 50 (Block 102) where it mixes with bypassed excess dry feed (Block 104), together with hot formed briquettes (from Block 106) and recycled crushed briquettes (from Block 108), and effects heat exchange, to cool the briquettes (from Block 103), and to partially dry and pre-heat the mixed wet feed stock.

The cooled briquettes then are separated from the mixed and now heated feed stock, which now includes crushed briquettes and excess briquette stock, by bypass and by spillover, at Block 110.

A selected quantity of briquettes is then separated, at Block 112, for recycling, passing to Block 108 for that purpose. The bulk of the briquettes pass as product, Block 113, to "FINISH" of the cycle.

The now pre-heated feed is transferred and blended, Block 114, in hopper 36 and injected as feed stock, Block 116, to the flash dryer 30 by way of tee piece 32, where the feed stock is mixed with the high velocity hot stream of reducing gas.

Flash drying and transfer, Block 118, by way of tube 40 to cyclone separator 38, leads to separation of the dried particulates from the hot gas, Block 120. A portion of the hot, dry particulates is precompacted, Block 122, and passes to the press for briquetting, Block 106. The excess dry feed bypasses to conveyor 50, Block 104, to thus complete the feed cycle.

Ambient air enters, Block 124, for preheating by way of a stack gas recuperator, before passing to compressor 18, Block 126, where it is compressed.

The preheated and compressed air passes to burner 14 and combustion chamber 16 for injection of fuel, Block 127, to generate reducing gas, referred to above, Block 128. Recycled bypass gas returned to compressor 26 is compressed, Block 130, and mixed with the newly generated reducing gas, in hot gas chamber 17, Block 132. At tee piece 32, which may include a high velocity venturi nozzle (not shown) the mixed reducing gas mixes with the injected feed, Block 116, which it entrains, transfers and flash dries, Block 118.

Transferred by way of tube 40 to cyclone 38, most of the hot, moist reducing gas is separated from the dry feed, Block 120, and passes to tee piece 77, where a major portion is divided, Block 134, and returned as bypass gas to the drying cycle at Block 130. The remaining portion of the hot gas passes as stack gas to the recuperator (not shown) to preheat the incoming ambient air, Block 124; and passes thence to a dust collector for collection of dust, Block 136, and thence to stack.

Dust from the collector (not shown) may be divided, Block 137, to send all, or a portion thereof to discard if unsuitable for further processing, or it may be returned with the bypass feed, Block 104 for mixing with the feed, Block 102.

Process temperature control is effected by injecting water as coolant, Block 138, into evaporator tube 30, to control tube temperature, Block 140, and hence the maximum temperature of the dry feed.

Figure 3:
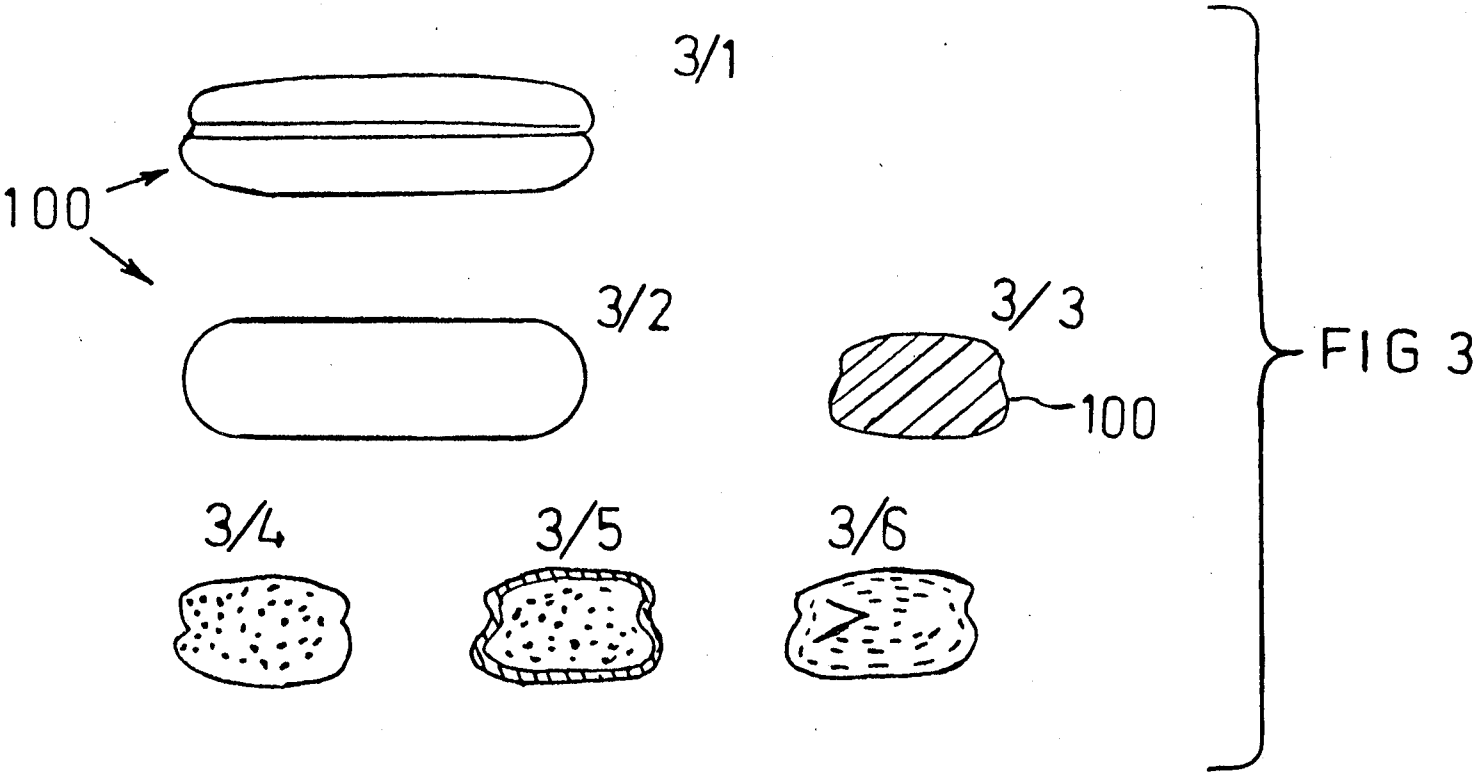
FIG. 3 comprises views of typical briquettes, including sections of briquettes showing typical levels of progressive formation.

Referring to FIG. 3, view 3/1 is a side elevation of a briquette 100; view 3/2 is a plan view of the briquette 100, and 3/3 is an end section thereof.

Section view 3/4 is that of a consolidated but non-fused briquette, wherein the temperature of the pre-compressed feed entering the press was insufficient to produce plastic flow, in response to the compressive forces applied by the press, thereby retaining distinct and clearly visible grain boundaries.

Section 3/5 shows a partially fused briquette wherein fusion of the outer casing takes place, in response to the compressive force applied to the casing surface by the press, but the briquette material temperature is too low to fuse the internal grain boundaries in response to the compressive pressure applied.

Section view 3/6 shows a fully fused briquette wherein full plastic flow has taken place; substantially homogeneous briquette formation is obtained. In this latter state maximum handleability, waterproofness and strength is achieved. The smoothness and light reflectivity of the external surfaces of the whole briquettes, and of the internal surfaces of broken briquettes are indicative to a degree of the extent to which uniform plasticity has been achieved in the briquette formation process. Upon cooling and standing, the briquette strength is observed to further increase as a probable consequence of a secondary phenomenon resulting from the process.

The extent of recirculation of crushed briquettes is based upon the satisfactory handling of the feed and also the performance of the pre-densification and pressing steps of the process, in which the particulate material of the crushed briquettes plays a significant role.

Certain examples of bituminous coals, their as-received analysis, and that of the resulting briquettes are as follows:

TABLE 1

Quality, Size Distribution, and Fractional Ash Content of a Typical Froth Flotation Filter Cake Sample.

1. Proximate Analysis:

| Parameter | As Received Basis | Dry Basis |
|---|---|---|
| Moisture (%) | 26.0 | — |
| Ash (%) | 9.0 | 12.16 |
| Sulphur (%) | 1.27 | 1.72 |
| Calorific Value (Kj/Kg) | 22,400. | 30,270. |
| MAF C.V. (Kj/Kg) | — | 34,462. |
| Volatile Matter (%) | 19.7 | 26.62 |
| Fixed Carbon (%) | 45.3 | 61.21 |
| Chlorine (%) | 0.18 | 0.24 |
| SO(2) Ratio (Kg/mmKj) | 1.13 | 1.14 |

2. Size Distribution and Fractional Ash Content:

| Size Fraction | % Distribution | % Ash in Fraction (Dry Basis) |
|---|---|---|
| Plus 500 um | 4.0 | 3.0 |
| 500 × 250 um | 18.2 | 4.3 |
| 250 × 125 um | 18.0 | 7.4 |
| 125 × 63 um | 16.7 | 9.1 |
| 63 × 45 um | 6.0 | 9.6 |
| minus 45 um | 37.1 | 18.0 |
| Cumulative | 100.00 | 11.0 |

Where: "Kj/Kg" represents Kilo-joules per kilogram
"Kg/mmKg" represents Kilograms per million Kilojoules.
"UM" (Micro meters of Microns) represents 10–6 meters TABLE 1-continued Quality, Size Distribution, and Fractional Ash Content of a Typical Froth Flotation Filter Cake Sample.

[a 1/10 6 meters]

TABLE 2 (1)

Analysis of Briquette Products Made from Feed of Table 1.

1. Proximate Analysis

| Parameter | Analysis: As Received Basis | Analysis: Dry Basis |
|---|---|---|
| Moisture (%%) | 1.5 | — |
| Ash (%) | 10.11 | 10.27 |
| Sulphur (%) | 1.74 | 1.77 |
| Calorific Value (Kj/Kg) | 30,710.00 | 31,189. |
| MAF C.V. (Kj/Kg) | — | 34,758. |
| Volatile Matter (%) | 30.00 | 30.47 |
| Fixed Carbon (%) | 58.35 | 59.26 |
| SO(2) Ratio (Kg/mmKj) | 1.14 | 1.14 |

2. Ultimate Analysis (Dry Basis):

| | Dry Basis |
|---|---|
| Carbon | 75.53 |
| Hydrogen | 4.57 |
| Nitrogen | 1.12 |
| Chlorine | 0.19 |
| Ash | 10.27 |
| Sulphur | 1.77 |
| Oxygen | 6.55 |

3. Ash Fusion Temperature:

| | Temperature (degrees C.): Oxidizing | Temperature (degrees C.): Reducing |
|---|---|---|
| Initial Deformation | 1,246 | 1,183 |
| Spherical Softening (H = W) | 1,401 | 1,272 |
| Hemispherical (H = ½ W) | 1,416 | 1,346 |
| Fluid | 1,496 | 1,379 |

It has been found from this and other tests carried out in a pilot sized plant in accordance with the invention that with bituminous coal material which has been dried to moisture content levels equal to or less than the inherent moisture content of the parent material, (typically in the range of about 1.5% total moisture content by weight and with essentially no interparticle moisture); and at pressures of between about 30,000–50,000 pounds per square inch in the press a temperature window of about 175 degrees to 200 degrees C. exists where briquettes were fairly consistently produced, wherein plastic flow occurred, initially on the skin and progressively inwardly at the higher temperatures, and wherein the granularity associated with the parent feed material progressively vanishes and homogenaiety is achieved. This leads to stronger, more water resistant briquettes. However, briquettes have been formed at temperatures of about 75° C., wherein, while plastic flow did not occur, handleable briquettes of somewhat reduced strength characteristics have been obtained. It will be understood that below the idealized temperature range of 175° to 200° C. there is an extended range of usefulness of the present process, down to temperatures in the order of about 75° C. and up to temperatures in the order of about 250° C.

The embodiments of the invention in which an exclusive property of priviledge is claimed are defined as follows:

1. A process for restructuring particulate coal fines without the introduction of extraneous binder material, comprising the steps of:

drying coal particle feed material substantially comprising particles in the size range up to 1/16 inch square, and predominantly in the range 28 mesh to zero, to remove interfacial water, and heating the material to a temperature in the range of about 75 to 250 degrees Celsius, within a reducing gaseous environment;

compressing the material into a constrained briquette form at a pressure in the range 30,000 to 50,000 psi, within said environment, to cause plastic flow in bridging relation with granular interfaces of the body, to at least form a coherent body having a dense cohesive case of relatively low porosity; and, cooling the formed body to a temperature below the auto-ignition temperature of said form, whereby there is imparted to the briquette sufficient strength when cool to withstand bulk handling without substantial damage.

2. The process as set forth in claim 1, wherein said drying and heating steps take place in a high velocity stream of reducing gas.

3. The process as set forth in claim 2, including the step of generating said high velocity gas stream by combusting fuel with insufficient oxygen for total combustion.

4. The process as set forth in claim 1, wherein said drying and heating are carried out in a reducing gas stream; including the step of recirculating hot reducing gas, and mixing the recirculated gas with hot gaseous products of combustion, at a temperature close to the boiling point of water.

5. The process as set forth in claim 4, including the step of maintaining said heated material in an environment containing substantially no air.

6. The process as set forth in claim 5, wherein said process steps are carried out in an enclosing apparatus wherein the gaseous pressure within the apparatus in the presence of said heated material is maintained above atmospheric pressure, to substantially preclude the ingress of air therein.

7. The process as set forth in claim 6, including the step of passing wet, particulate feed material in direct, heat exchange relation with a said heated formed body, prior to carrying out said heating and forming steps.

8. The process as set forth in claim 1, including the steps of crushing a selected quantity of briquettes and mixing the particulate material thus formed with wet feed material in the process.

9. The process as set forth in claim 1, wherein compressing of said feed material is carried out in a press, said process including the steps of drying a quantity of said feed material at a rate in excess of the instantaneous requirements of said press, mixing a quantity of said excess dried feed material with wet feed material to provide mixed feed material, and contacting a said formed body in heat exchange relation with said mixed feed material.

10. The process as set forth in claim 9, including the step of pre-compressing said feed material prior to entry thereof within said press.

11. The process as set forth in claim 4, including separating dried heated feed material from said reducing gas stream; passing a selected portion of said separated gas stream to atmosphere, said selected portion being sufficient to contain a quantity of water vapor and prior combustion products in substantial balance with the quantities of water evaporated from wet feed material and products formed by combustion within the process to maintain substantial equilibrium therein, the remaining portion of said gas stream being recirculated in mixing relation with said combustion products.

12. The process as set forth in claim 10 including the step of passing incoming combustion air in heat exchange relation with hot flue gases leaving the process.

13. The process as set forth in claim 10 including the step of limiting the temperature of said reducing gaseous environment by injecting water into said gaseous environment.

14. The process as set forth in claim 1 including the step of adding up to about five percent by weight, calcium equivalent basis, of crushed material in particulate form selected from crushed limestone and other calcitic/dolomitic divalent crushed materials to said coal particle feed material, for purposes of sulphur dioxide emission control during subsequent combustion of said formed body.

15. An apparatus for reconstituting coal from naturally occurring coal fines wet feed material of variable water content, generally in the size range up to 1/16 inch mesh and predominantly particulate 28 mesh to zero into a compacted form possessing adequate crushing strength to withstand bulk handling without substantial damage, comprising a high pressure cavity die roll press operable in a pressure range above about 30,000 psi to about 50,000 psi; gas heating means for producing hot reducing gas at a pressure above atmospheric; dryer means to receive said hot reducing gas and said wet feed material in mutual heat exchange relation therein to evaporate a portion of said water content and to raise the temperature of said feed material to the plasticity point; first feed means for feeding said feed material to said press including feed bypass means to bypass feed material past said press; and second feed means including first cooling means to cool said compacted form in heat exchange relation with said wet feed material; and second cooling means to cool said compacted form to a cooled, non-auto combusting condition.

16. The apparatus as set forth in claim 15, including gas mixer means for mixing said hot gas with recirculated gas, and gas recirculation means to maintain the ambient pressure of the mixed gases above atmospheric pressure.

17. The apparatus as set forth in claim 15, including heat tempering means for selectively reducing the gas temperature within said dryer means.

18. The apparatus as set forth in claim 16, said heat tempering means comprising a coolant liquid injection system.

19. The apparatus as set forth in claim 15, said feed means including compressing means for pre-compressing said feed material on passage thereof to said press means.

20. The apparatus as set forth in claim 15, wherein said high pressure press is a briquetting mill having a pair of cooperatively rotatable rolls.

21. The apparatus as set forth in claim 15, including gas separation cyclone means to receive said hot reducing gas and said feed material in centrifuging, mutually separating relation therein; gas flow blocking means to permit the passage of said feed material from said cyclone means; stack means to receive, in use, said hot reducing gas in substantially separated relation from said feed material; gas bypass means to receive a portion of said separated reducing gas in recycle transfer relation with said gas generator means, for mixing with said fuel burner combustion products; and control means for apportioning said separated hot reducing gas between said bypass means and said stack means.

22. The apparatus as set forth in claim 15, wherein said cooling means comprises particulate feed material in a cool condition.

23. The apparatus as set forth in claim 15, said gas generator means including burner means for generating gaseous combustion products, gas bypass means for recycling hot gas within the apparatus, and mixing chamber means to receive said combustion products and said recycled gas in mixing relation therein.

24. A compressed body comprising coal particles in formed and fused, cohesive relation, said body having a coherent substantially unitary outer skin, and containing a total moisture content substantially not greater than the inherent moisture content of said feed material.

25. The compressed coal body as set forth in claim 24, having a degree of plastic fusion within said outer skin sufficient to impart strength characteristics to said body of crushing strength up to about 120 to 130 psi, and resistance to substantial fragmentation on drop testing upon a hard surface.

26. The compressed coal body as set forth in claim 24, being internally fused to preclude the substantial presence of particle interfaces within said body.

27. The compressed coal body as set forth in claim 24, said degree of plastic fusion being sufficient to impart homogeneous fusion to the body sufficient to permit dropping of the body on to a concrete surface from about 15 feet, without substantial fragmentation thereof.

28. The apparatus as set forth in claim 15, said feed means including a surge hopper to receive feed material in accumulated relation therein, for passage therefrom to said dryer means, whereby local variations in feed rate may be accommodated.

29. The process as set forth in claim 1, wherein said particulate coal fines comprises wet feed stock having a moisture content in the range 20 to 35 weight percent.

* * * * *